United States Patent [19]

Hesse

[11] Patent Number: 4,919,639

[45] Date of Patent: Apr. 24, 1990

[54] TOY VEHICLE

[76] Inventor: Kurt Hesse, Waldstrasse 36, 8510 Furth, Fed. Rep. of Germany

[21] Appl. No.: 271,778

[22] PCT Filed: Dec. 3, 1987

[86] PCT No.: PCT/EP87/00752

§ 371 Date: Nov. 9, 1988

§ 102(e) Date: Nov. 9, 1988

[87] PCT Pub. No.: WO88/05327

PCT Pub. Date: Jul. 28, 1988

[30] Foreign Application Priority Data

Jan. 24, 1987 [DE] Fed. Rep. of Germany ..... 3702043
Jan. 24, 1987 [DE] Fed. Rep. of Germany ..... 3702040

[51] Int. Cl.[5] ..... A63H 17/00; A63H 17/267

[52] U.S. Cl. ..... 446/462; 446/95; 446/471; 446/469; 446/484

[58] Field of Search ..... 446/471, 470, 469, 465, 446/462, 93–96, 128, 484

[56] References Cited

U.S. PATENT DOCUMENTS 3,540,151 11/1970 Ishida ..... 446/462 X
3,668,806 6/1972 Pauly .
3,711,989 1/1973 Nielsen et al. .
4,375,139 3/1983 Chatani ..... 446/471
4,636,178 1/1987 Oda ..... 446/462

FOREIGN PATENT DOCUMENTS 1090143 9/1960 Fed. Rep. of Germany .
1199119 12/1959 France .
2258765 8/1975 France .
1347963 10/1987 U.S.S.R. ..... 446/93
2106402 4/1983 United Kingdom .

*Primary Examiner*—Mickey Yu
*Attorney, Agent, or Firm*—Browdy and Neimark

[57] ABSTRACT

In a toy vehicle having a chassis travelling by means of wheels on a driving surface and a body which can be fastened thereon, the vehicle chassis has fixed on the side towards the body at a distance adjacent to each other a number of pegs and the vehicle body has fixed on the side towards the chassis at the same distance and in relation to the pegs a number of sleeves which can be pushed onto the pegs of the vehicle chassis so they are frictionally engaged for the purpose of interchangeable application of any desired body on the same vehicle chassis.

8 Claims, 2 Drawing Sheets

TOY VEHICLE

BACKGROUND OF THE INVENTION

1. Field of the Invention

The invention relates to a toy vehicle having a chassis travelling by means of wheels on a driving surface and with a body which can be fastened thereon.

2. The Prior Art

In known toy vehicles, the body is designed in a predetermined manner and is connected with the chassis in a complicated way by bent pieces or wedging means. Aside from the fact that such toy vehicles require complicated use of tools for accessing their interiors, perhaps for changing the power source or for repairs, the retention of the body is also imperative. Exchange of the body is either not possible or requires a difficult adaptation to the chassis or requires a chassis adapted to the respective body.

3. Summary of the Invention

It is an object of the invention to provide means for attaching any desired body on the vehicle chassis while retaining the same vehicle chassis.

This object is attained in accordance with the invention in that the vehicle chassis has fixed on the side towards the body at a distance adjacent to each other a number of pegs and the vehicle body has fixed on the side towards the chassis at the same distance and in relation to the pegs a number of sleeves which can be pushed onto the pegs of the vehicle chassis so they are frictionally engaged. The pegs and sleeves are preferably arranged in rows on the vehicle chassis or the vehicle body, an arrangement in multiple rows of the pegs or sleeves having proven advantageous and resulting in solid connections. In this way the pre-conditions for a simple exchange of any desired body on a vehicle chassis which can be retained unchanged are given by means of a simple plug procedure. Fixing each body to be used on the vehicle chassis or taking it off can be done without tools. To adjust for variations, the stubs are appropriately provided with adjustment pieces extending beyond their circumferential surfaces, which provide clamping engagement by their deformation when the sleeves are pushed on. It is to be understood that the adjustment pieces may also be provided on the inner circumferential surface of the sleeves, while the pegs are smooth on their outside.

The design of the toy vehicle provides that the structure of the vehicle chassis be formed boxlike by two vehicle chassis parts disposed on top of each other and connectable in a plane parallel to the plane of the driving surface, both of which can be connected by means of a peg disposed on a chassis part and a sleeve provided on the other chassis part, which can be pushed on the peg. The vehicle chassis thus formed is used, besides as a support for the wheels, for containing the power sources and transmission as well as the drive motor. Suitably one chassis part may be used as a reception chamber for a low voltage power source and a reception space for the drive motor, while the other chassis part receives a wheel drive, the electric conductors at least partially and a switching device. Protrusions or flanges provided on the chassis parts may be used to hold down the power source and the electrical conductors which are formed, for example, by loosely inserted conductor tracks. Fixing of the drive motor in the receptacle of the one chassis part may be made by means of frictional clamping. The electrical connection between drive motor and electric conductors is made by simply pressing them together.

It is provided in a further embodiment that the two chassis parts are provided with half shells which together form bearings for the vehicle wheels or wheel axles. In particular the two front vehicle wheels may be placed into two identical half shells extending one above the other, one of which is disposed on an extension of the upper chassis part and the other on the lower chassis part. Suitably, however, the rear vehicle wheels are fixedly disposed on an axle which is placed in recesses of both chassis parts.

It is further provided that each of the front vehicle wheels engages the half shells by means of a cylindrical axle journal in a freely rotatable manner and that the axle journals rotatably engage an annular groove provided in the half shells by means of annular bodies or sections of annular bodies fixed to the axle journals and extending beyond the circumferential surfaces of the same for the purpose of axial fixation of the wheels in the half shells. Preferably the axle journals are formed by tube or sleeve sections. The design provides the possibility of mounting the wheels by simple plugging operations, the axle journals contributing to the mounting of the wheels with only little play because of their relatively large diameter, while the annular bodies or annular body sections keep axial bearing play within narrow limits. Mounting of the wheels on the chassis can take place without tools and the otherwise customary molding of metal parts for axles or shafts is not necessary.

In accordance with a preferred design the half shells can be supported against each other axially and transverse to the longitudinal axes of the half shells by means of grooves and springs formed on their common interfaces. Suitably one of the half shells has the springs, while the associated other half shell is provided with grooves. There is also the possibility of providing a spring on each half shell and a groove diametrically opposed to the spring.

It is to be understood that the annular bodies and the annular grooves may have any desired cross-sectional shape and cross-sectional size. In accordance with a preferred design the annular bodies and the annular grooves are made with a trapezoid cross section. Because of their mutual support the wedge faces of the trapezoidal shape lead to a mounting of the wheels which is particularly free of play. It is possible to make the annular bodies and annular grooves with semi-circular cross sections.

BRIEF DESCRIPTION OF THE DRAWINGS

The invention is described in the drawings by means of exemplary embodiments, in which:

FIG. 7 is a chassis part of a different embodiment in a lateral view,

FIG. 8 is a lower chassis part of a changed embodiment in an top view,

FIG. 9 is an upper chassis part of a changed embodiment in an top view,

FIG. 10 is a wheel in a lateral view, enlarged and partially in section,

FIG. 11 is a partial section of a chassis, enlarged, and

FIG. 12 is a section along the line XII—XII of FIG. 10, enlarged.

DETAILED DESCRIPTION OF THE PREFERRED EMBODIMENT

Figures 1, 2, 3, 4, 5, 6:
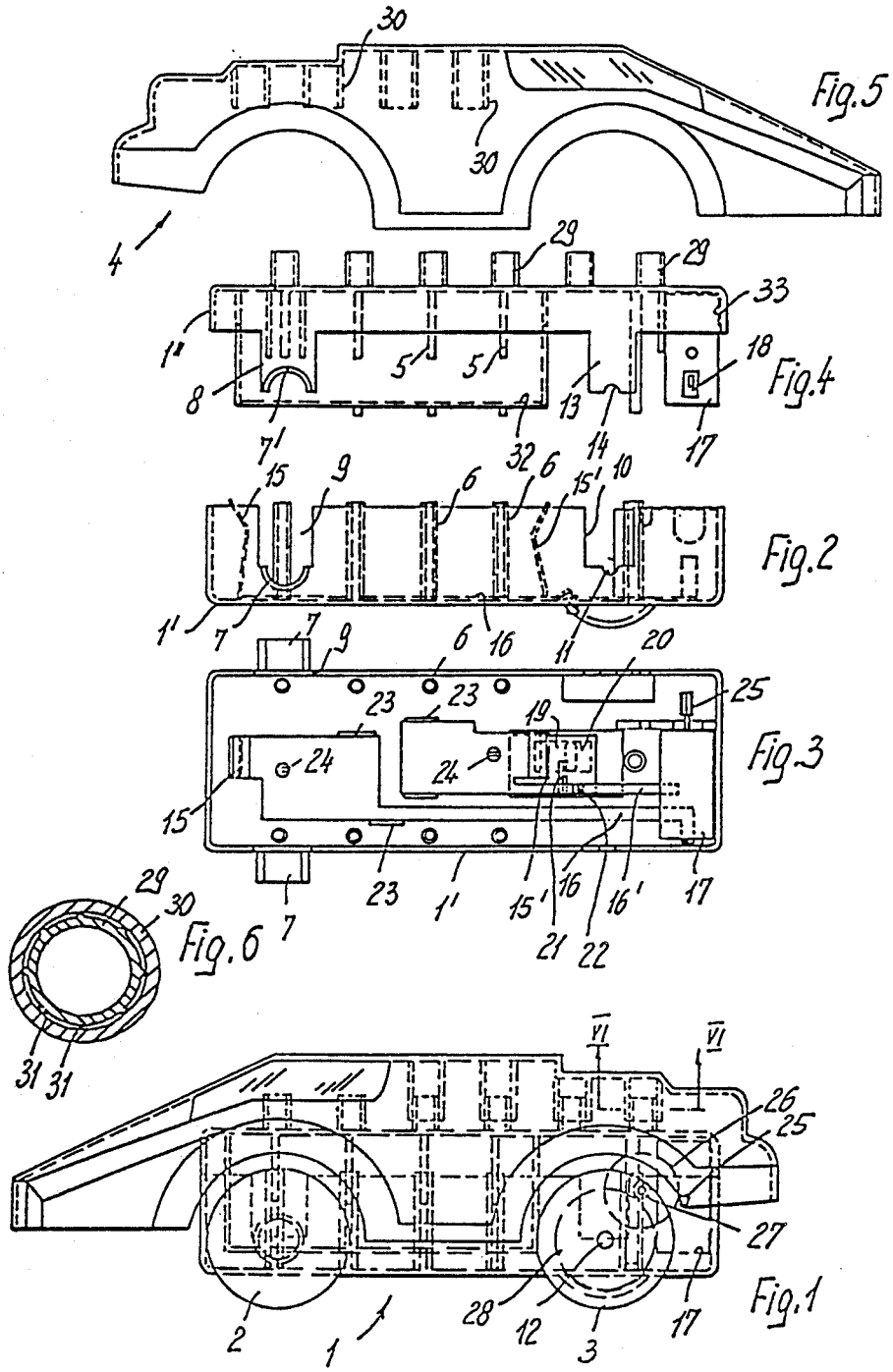
FIG. 1 is a toy vehicle in a lateral view.
FIG. 2 is a lower chassis part in a lateral view.
FIG. 3 is a chassis part according to FIG. 2 in a top view.
FIG. 4 is an upper chassis part in a lateral view.
FIG. 5 is a body in a lateral view.
FIG. 6 is a section along the Line VI—VI of FIG. 1.

In the drawings, 1 indicates a chassis which can be rolled in a known manner on driving surfaces (not shown) by means of front wheels 2 and rear wheels 3. 4 indicates a body of any desired design, which is to connect with the chassis 1. In the exemplary embodiment, the chassis 1 is formed by a lower chassis part 1' and an upper chassis part 1" which together result in a box-like chassis part 1. The two chassis parts 1' and 1" can be connected with each other by a sliding operation in which pegs 5 disposed on the chassis part 1" descend in a frictionally engaging manner into the sleeves 6 on the chassis part 1'. In the vicinity of its front on the exterior of both sides in the area of recesses 9, the chassis part 1' is provided with half shells 7 which, when the chassis part 1' is attached, make complete wheel supports together with half shells 7' disposed on extensions 8. Furthermore the chassis part 1' has a semiapertual bearing opening 11 for a drive axle 12 of the rear wheels 3 in the area of further recesses 10. Further extensions 13 with semiapertual bearing openings 14 descend into the recesses 10 when the two chassis parts 1' and 1" are connected. On the inside of the chassis part 1', connecting springs 15, 15' are disposed which can be connected with an electric motor 17 via electrical connectors 16, 16'. The chassis part 1" receives a battery (not shown) in a reception chamber 32 and is provided with a reception space 33 for the drive motor 17. Connection of the electrical conductor 16 with the drive motor takes place by pressing it against an insulated contact 18 of the drive motor 17 and the connection of the electrical conductor 16' takes place by means of a sliding switch 19 which is movable in a longitudinal direction in a recess 20 of the chassis part 1'. The sliding switch 19 has a wedge-shaped protrusion 21 which by a sliding motion lifts the electrical conductor 16' out of a deflection 22 and puts its free end against a further motor contact, e.g. the motor housing. Pieces for the retention of the electrical conductors 16, 16' are designated with 23, while 24 indicates protrusions for retaining the same on the chassis part 1'.

The drive motor 17 acts via a cam 25 on a drive wheel 26 and a cam 27 which meshes with a further gear wheel 28 fixedly disposed on the drive axle 12 of the rear wheels 3.

The chassis part 1" has on its upper surface pegs 29 which, in the exemplary embodiment, are formed in two rows next to each other. The body 4 can be slid on the pegs 29 by means of sleeves 30 and can be connected with it (FIG. 1). For the purpose of compensating for manufacturing variations, the pegs 29 may have adjustment pieces 31 in their outer surfaces which because of their deformation result in a secure seating of the body 4 on the chassis 1.

In the toy vehicle the front wheels 2 are each independently brought into freely rotatable contact with the chassis 1. For this purpose the front wheels 2, as is shown in particular in FIG. 10, rotatably engage with a tube or sleeve section in the form of an axle journal 37 bearings of the chassis 1 formed by half shells 7, 7'. To axially fix the front wheels 2, the axle journals 37 are provided with an annular body or annular body sections 38 extending beyond their circumferential surfaces, which engage annular grooves 39 of the half shells 7, 7'.

The one half shell 7" has springs 40 and the other half shell 7' has grooves 41 for the mutual alignment of the half shells 7, 7". By means of the descent of the springs 40 into the grooves 41 the alignment automatically takes place through a simple sliding motion.

For fixing the front wheels 2 it must first be assumed that the two chassis parts 1' and 1" are maintained on top of each other at a distance. In this position of the chassis parts the front wheels 2 can be placed with their axle journals 37 into the lower half shells 7' and, by the subsequent application of the upper chassis part the upper half shells 7" can be combined with the lower half shells 7' into annularly closed bearings, in which the axle journals 37 are maintained with no or little axial play by means of the annular bodies 38.

In the exemplary embodiment of FIG. 12 annular body sections 38' provided on the axle journals 37 are used for the axial fixing of the front wheels 2.

I claim:

1. A toy vehicle comprising:

a chassis which is adapted to travel by means of wheels on a driving surface;

a body is adapted to be fastened on the chassis the vehicle chassis comprising a plurality of first pegs fixed on the side towards the body at a distance adjacent to each other;

the vehicle body comprising a plurality of first sleeves fixed on the side towards the chassis at the same distance and in relation to the plurality of first pegs which can be pushed onto the plurality of first pegs of the vehicle chassis so they are frictionally engaged;

the vehicle chassis being formed boxlike by two vehicle chassis parts disposed on top of each other and connectable in a plane parallel to the plane of a driving surface, both of which are connected by means of second pegs disposed on one chassis part and second sleeves provided on the other chassis part which can be pushed on the second pegs, wherein the one chassis part comprises a reception chamber containing a low voltage power source and a reception space containing a drive motor and the other chassis part comprises electric conductors extending into said reception chamber and a switching device providing or interrupting electrical contact between the drive motor and one of said electric conductors.

2. The toy vehicle in accordance with claim 1, wherein the drive motor is fastened in said reception space of the one chassis part by means of frictional clamping and can be connected with the electrical conductors by touch contact.

3. The toy vehicle in accordance with claim 1, wherein the two chassis parts comprise half shells which complement each other to form bearings supporting axle journals having a tube or a sleeve section on which one free end a vehicle wheel is provided.

4. The toy vehicle in accordance with claim 3, wherein said axle journals of the vehicle wheels are supported in said half shells extending one above the other, one of which is disposed on an extension of the one chassis part and the other on the other chassis part.

5. The toy vehicle in accordance with claim 4, wherein a cylindrical axle journal of each front vehicle wheel engages the bearing formed by said half shells in a freely rotatable manner and the axle journals rotatably engage an annular groove provided in the half shells by means of annular bodies or sections of annular bodies fixed to the axle journals and extending beyond the circumferential surfaces of the axle journals for the purpose of axial fixation of the vehicle wheels in the half shells with substantially no axial play.

6. The toy vehicle in accordance with claim 3, wherein the one half shell has springs and the other half shell has grooves, so that an alignment automatically takes place by means of the desent of the springs into the grooves through a sliding motion.

7. The toy vehicle in accordance with claim 5, wherein the annular bodies and the annular grooves are formed with trapezoid cross sections.

8. The toy vehicle in accordance with claim 5, wherein the annular bodies and the annular grooves are formed with semicircular cross sections.

* * * * *